United States Patent [19]

Rauch

[11] 4,382,363

[45] May 10, 1983

[54] STIRLING ENGINE DISPLACER SUSPENSION SYSTEM

[75] Inventor: Jeffrey S. Rauch, Schenectady, N.Y.

[73] Assignee: Mechanical Technology Incorporated, Latham, N.Y.

[21] Appl. No.: 270,893

[22] Filed: Jun. 5, 1981

[51] Int. Cl.[3] ..... F02G 1/04

[52] U.S. Cl. ..... 60/520; 60/517

[58] Field of Search ..... 60/517, 520; 62/6

[56] References Cited

U.S. PATENT DOCUMENTS 3,645,649 2/1972 Beale ..... 60/517 X

*Primary Examiner*—Allen M. Ostrager
*Assistant Examiner*—Stephen F. Husar
*Attorney, Agent, or Firm*—Joseph V. Claeys; Arthur N. Trausch, III

[57] ABSTRACT

A free piston Stirling engine includes a hermetically sealed vessel enclosing a working space which is filled with a working gas such as helium. A displacer is mounted in the working space on a suspension apparatus for axial reciprocation to displace working gas back and forth sequentially through a heater, a regenerator, and a cooler to create a cyclic pressure wave which drives a power piston. The displacer is connected to a mounting flange fixed to the vessel by a bellows which permits the displacer to move axially. A diaphragm is connected to the mounting flange and seals an oil cavity whose sides are defined by the bellows. The top of the oil cavity is formed by a transverse wall in the displacer, in which is formed a cylinder which receives a stationary piston mounted on a spider in the oil cavity and fastened to the mounting flange. The axial motion of the displacer is accommodated by the bellows, and the distributed pressure forces of the working gas pressure wave are conducted through the diaphragm and fluid in the cavity to the displacer transverse wall. The volumetric displacement of fluid in the cavity caused by axial expansion and compression of the bellows is accommodated by a corresponding displacement of the cylinder relative to the fixed piston, so the volume in the cavity stays virtually constant and the only substantial stress to which the diaphragm is subjected is the displacement induced stress that enables the diaphragm to function as a centering spring, and not pressure induced stress.

6 Claims, 2 Drawing Figures

STIRLING ENGINE DISPLACER SUSPENSION SYSTEM

BACKGROUND OF THE INVENTION

This invention relates to Stirling engine displacer suspension systems, and more particularly to an oil filled system for suspending a free displacer in a free piston Stirling engine.

This invention is related to application Ser. No. 172,373 for "Diaphragm Displacer Stirling Engine Powered Alternator-Compressor," filed on July 25, 1980, by Folsom, et.al., and application Ser. No. 270,974 for "oil-Backed Stirling Engine Displacer Diaphragm" filed by me concurrently herewith, and application Ser. No. 270,892 for "Sealed Oil-Backed Displacer Suspension Diaphragm" filed by Nicholas Vitale concurrently herewith, the disclosures of which are all incorporated herein by reference. The engine of the '373 application is a free piston Stirling engine which utilizes a diaphragm to suspend the displacer in the working space and uses the pressure wave in the working space to maintain the displacer oscillation. Although the machines disclosed in these applications constitute significant progress in the art, there are some areas in which modifications would improve overall performance.

In the machine of the '373 application, the displacer diaphragm is subjected to stress induced by the pressure swing of the working gas in the working space which is on the order of 10% to 20% of the charge pressure in the working space which can be on the order of 40–80 bar which, acting over the full face of the diaphragm, can introduce considerable stress in the diaphragm. This complicates the deformation pattern of the diaphragm and reduces its working life. This pressure induced stress does not contribute to the operation of the machine. The only stress that contributes desirable design function is displacement induced stress, that is, the spring effect contributed by the diaphragm when it is displaced from its central position. This necessary and desirable stress in the diaphragm is compounded and multiplied in unpredictable ways and with deleterious results by pressure induced stresses in the diaphragm which greatly complicates the diaphragm design and reduces diaphragm reliability and repeatability. Moreover, the effect changes with changing pressure and therefore an additional degree of difficulty is introduced if a power control system based on mean pressure variation is used.

A second desirable area of improvement is control of the power input into the displacer itself. Power input into the displacer is related to the displacement ratio ($\Delta V/V$) of the difference $\Delta V$ between the volumetric displacements of the displacer in the expansion space and the compression space, to the volumetric displacement V of the expansion space. The power required to maintain the oscillation of the displacer in the working space, that is to overcome the friction of the moving displacer and windage losses of the working gas flowing through the heat exchangers, normally requires a ($\Delta V/V$) value of approximately 0.1. However, the deflection pattern of a diaphragm normally produces a value of ($\Delta V/V$) in an engine of this variety of approximately 0.3. This provides excessive energy to the displacer so that it slams back and forth between its stops unless some means is provided to extract the excess energy, or some technique is provided for limiting the ($\Delta V/V$) ratio, and hence the input energy to the displacer, to a value more suited to the engine operation.

Along these lines, it is possible by artful design of a displacer to enable it to operate with the characteristic desired, that it, with a small ($\Delta V/V$). Nevertheless, there is no assurance that the diaphragm will actually operate in this manner when mounted in the engine and operated at various pressures and other operating parameters, even though it is capable of doing so. Therefore, it is necessary to impose a form of restraint on the deformation pattern of the diaphragm in its operation so that it will conform to the desired configuration.

Another possible improvement would be to enhance the diaphragm life and reliability by reducing the stress which the diaphragm must carry. The diaphragm acts as a spring element to store energy when the displacer is displaced from its center position and to utilize the stored energy by returning the displacer from its stroke extremes toward the center position. The stress level in the diaphragm approaches its maximum at the displacer stroke extremes. At these extremes, it would be desirable to have a supplementary spring member assume a portion of the load so that the diaphragm need not carry the entire load.

Yet another improvement that I believe would be desirable would be to eliminate the mechanical connection between the displacer and the diaphragm, so that the diaphragm experiences only distributed fluid pressure forces and not concentrated mechanical forces. This design change should improve the diaphragm life, simplify its design, and reduce its cost.

SUMMARY OF THE INVENTION

Accordingly, it is an object of this invention to provide a displacer mounting system for a free displacer in a free piston Stirling engine wherein the displacement ratio is controlled. It is another object of this invention to provide a displacer mounting system having a displacer diaphragm wherein pressure induced stresses are reduced so that the only substantial stress to which the diaphragm is subjected is displacement induced stress. Yet another object is to provide a mechanical separation of the displacer diaphragm and the displacer, so the diaphragm experiences only distributed fluid pressure forces.

These and other objects of the invention are achieved in the preferred embodiments of the invention wherein a transverse wall across one end of the displacer forms one side of a cavity, the other side of which is formed by the displacer diaphragm. A volume adjusting device is provided which controls the cavity volume so that the diaphragm volumetric displacement is controlled by the cavity volume adjusting device. The displacer and the diaphragm are sealed together by a moving seal that permits the displacer to oscillate independent of the diaphragm. The stresses in the diaphragm are thus restricted to the displacement induced stresses created by distributed fluid pressure forces only, and diaphragm displacement is a function of the displacer displacement only and not the pressure effects which are transmitted through the diaphragm and the liquid in the cavity to the displacer transverse wall, thereby freeing the diaphragm of pressure induced stresses.

DESCRIPTION OF THE DRAWINGS

The invention and its many attendant objects and advantages will become better understood upon reading the following description of the preferred embodiment in conjunction with the following drawings, wherein.

DESCRIPTION OF THE PREFERRED EMBODIMENTS

Figure 1:
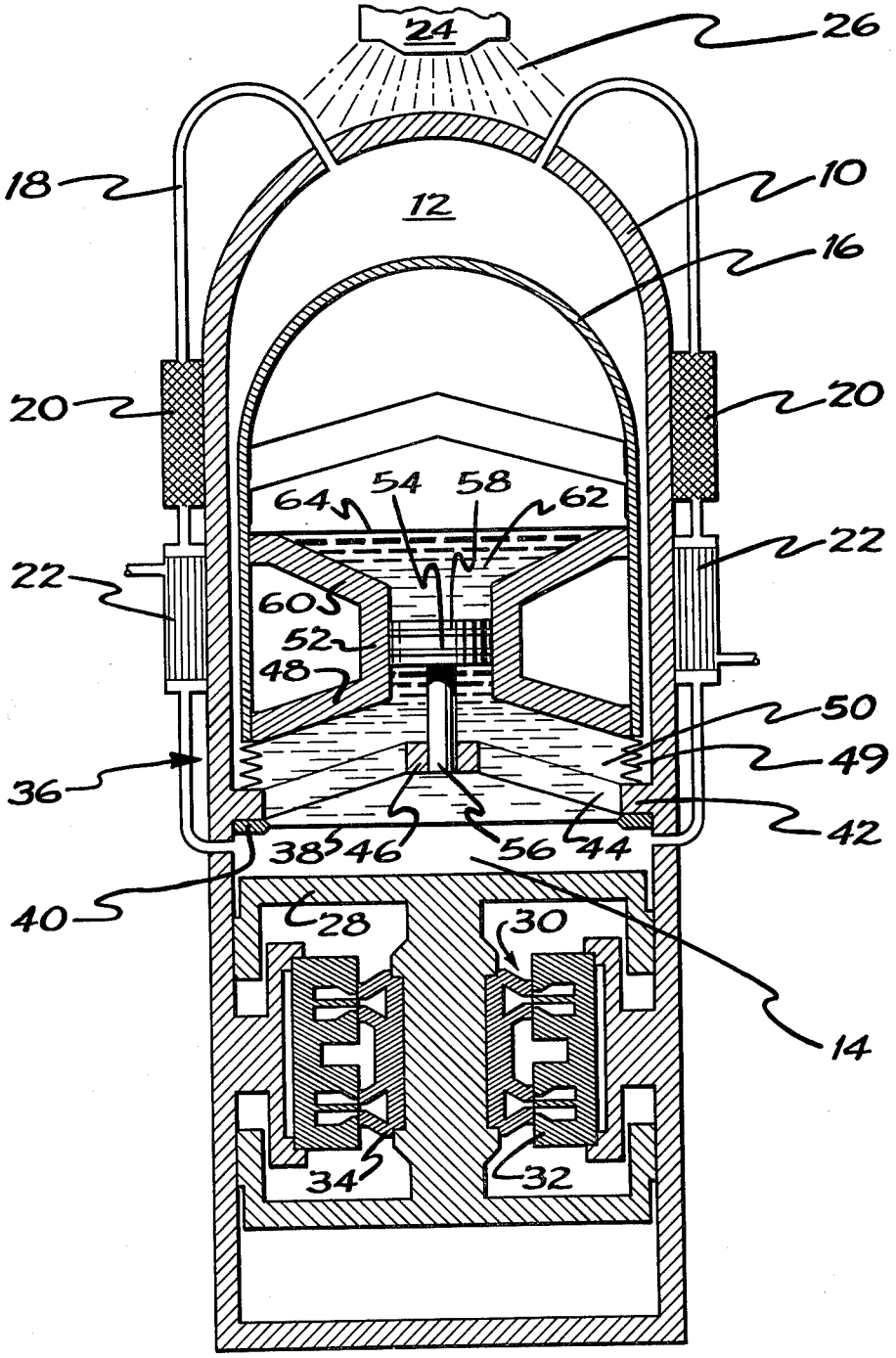
FIG. 1 is a sectional elevation of a free piston Stirling engine incorporating a displacer mounting system made in accordance with this invention.

Referring now to FIG. 1, a free piston Stirling engine is shown having a hermetically sealed vessel 10 enclosing a working space including an expansion volume 12 and a compression volume 14. A displacer 16 oscillates in the working space between the expansion volume 12 and the compression volume 14. The oscillation of the displacer 16 causes working gas to be circulated cyclically through a heater 18, a regenerator 20, and a cooler 22. The heater 18 is heated by combustion gases from a combustor 24 which burns liquid or gaseous fuel in a combustion space 26, and the cooler 22 is cooled by coolant circulating through the cooler 22 and rejecting the heat it collects in the cooler 22 in an external heat exchanger (not shown).

The lower end of the compression space 14 is defined by the top end face of a power piston 28 which produces output power, in this case, in the form of electrical power from a linear alternator 30. The alternator includes a stator 32 affixed to the interior wall of the vessel, and a plunger 34 which reciprocates opposite the stator 32 to switch the flux in the stator and induce electrical power, in the manner taught by U.S. Pat. No. 3,981,874 to Rotors, et.al.

A pressure wave is generated in the working space when the displacer 16 oscillates and circulates working gas through the heater 18, regenerator 20 and cooler 22. This pressure wave is caused by cyclic changes in temperature of the confined working gas as it passes through the heat exchangers. That is, as the displacer moves upwardly into the expansion volume 12, it displaces working gas from the expansion volume through the heater 18, into the regenerator 20 where the working gas deposits its heat in the regenerator matrix and is cooled thereby, and then into the cooler 22 where the working gas is cooled by the coolant flowing through the cooler 22. The cooled working gas then flows into the compression space 14 where it is compressed by the upwardly moving power piston 28 on the compression stroke when the majority of the working gas is in the compression space in the cooled state. This is the isothermal compression phase of the Stirling cycle. The displacer 16, which at this point is at its uppermost position in the working space, then begins to move downwardly, displacing cold, compressed working gas from the compression space 14 back through the cooler 22 through the regenerator 20 where it picks up the heat that it deposited on its previous pass, and then into the heater 18 where it is raised to the isothermal expansion temperature. The high temperature gas then expands into the expansion space 12 against the power piston 28, driving it downwardly to produce an output power stroke.

The displacer 16 is laterally and axially supported by a displacer suspension system 36 of this invention. The displacer suspension system 36 is mounted in the lower or cold end of the working space and provides the axial motive means for driving and phasing the displacer relative to the power piston. The power for driving the displacer and overcoming the viscous and frictional losses incurred by the circulation of working gas in the heat exchangers and by the motion of the displacer of the working space is provided by the displacer suspension system 36. The third function of the displacer suspension system is to provide a spring effect so that the displacer returns toward its midstroke position after displacement therefrom by the working gas pressure wave.

The displacer mounting system 36 includes a planar or convoluted diaphragm 38 which is fastened at its outer peripheral edge 40 to the underside of a mounting flange 42. The mounting flange 42 could be integral with the vessel 10, or preferably, for ease of construction, could be an annular member that fastens to the vessel wall after the displacer and its mounting system have been preassembled as a unit. The diaphragm 38 is welded or otherwise hermetically sealed to the mounting flange 42 so that there is no upward leakage of working gas into the fluid cavity above the diaphragm 38 and there is no leakage of liquid from the fluid cavity downward into the compression space 14. The mounting flange 42 also anchors a series of spider arms 44 which extend radially inward from the flange 42 to a spider body 46 located at the axial center of the vessel 10.

The lower end of the displacer 16 has fastened thereto, as by welding or other secure hermetic fastening means, a rigid wall 48 extending transversely across the bottom end of the displacer 16. A bellows 49 is connected between and hermetically seals the lower outer peripheral edge of the rigid wall 48 and the top of the mounting flange 42. The bellows 49 permits the displacer to move independently of the diaphragm while maintaining the hermetic seal between them. That is, there is a spring connection between the displacer and the diaphragm 38 to the extent of the spring effect of the bellows 49, but there is no hard mechanical connection between the displacer 16 and the diaphragm.

A liquid cavity 50 is defined between the bottom face of the rigid wall 48, the top face of the diaphragm 38, and the inner side faces of the bellows 49. The cavity 50 is filled with an incompressible liquid such as hydraulic fluid and functions, in a manner to be described below, to protect the diaphragm 38 from excessive stress and to confine the diaphragm to a deflection pattern that produces an optimum energy extraction from the thermodynamic system into the displacer 16.

An upstanding cylindrical wall 52 is formed coaxially on the center portion of the rigid wall 48 and receives a piston 54 mounted by way of a rod 56 to the body 46 of the spider so that the piston 54 is fixed axially with respect to the vessel 10. A set of piston rings 58 is mounted on the piston 54 to prevent leakage of fluid out of the cavity 50.

The rigid wall 48 is continued upward from the cylinder 52 in a conical flaring rigid wall extension 60 whose top outer peripheral edge is fastened to the displacer 16. A top or second fluid filled cavity 62 is defined between the upper face of the wall 60 and a second flexible diaphragm 64 fastened to the top of the rigid wall extension 60 or to the displacer wall 16.

In operation, the displacer suspension system 36 reduces the pressure induced stress on the diaphragm to that necessary to produce the displacer motion. It utilizes the controlled volume cavity 50 so that volumetric displacements of fluid in the cavity 50 caused by displacement of the diaphragm 38 and the axial expansion and compression of the bellows 49 as the displacer oscillates axially in the working space are matched by corresponding volumetric changes created by the movement of the cylinder 52 with respect to the piston 54 so that the volume of the cavity 50 remains virtually constant. In this way, the diaphragm 38 experiences primarily stresses created by its deflection into and out of the cavity 50, producing modified concave and convex shapes. The change in volume in the working space produced by the deflection of the diaphragm 38 is controlled by the piston 54 moving in a cylinder 52 as the displacer 16 moves axially. Since the bellows 49 can be designed to accommodate any desired displacer stroke, and the diaphragm can be designed merely as a pressure transmitting diaphragm and need not function as a mechanical suspension spring, the engine can now be designed with any desired displacer stroke 16 without excessively stressing the diaphragm 38, and with a hermetically sealed cavity 50.

Figure 2:
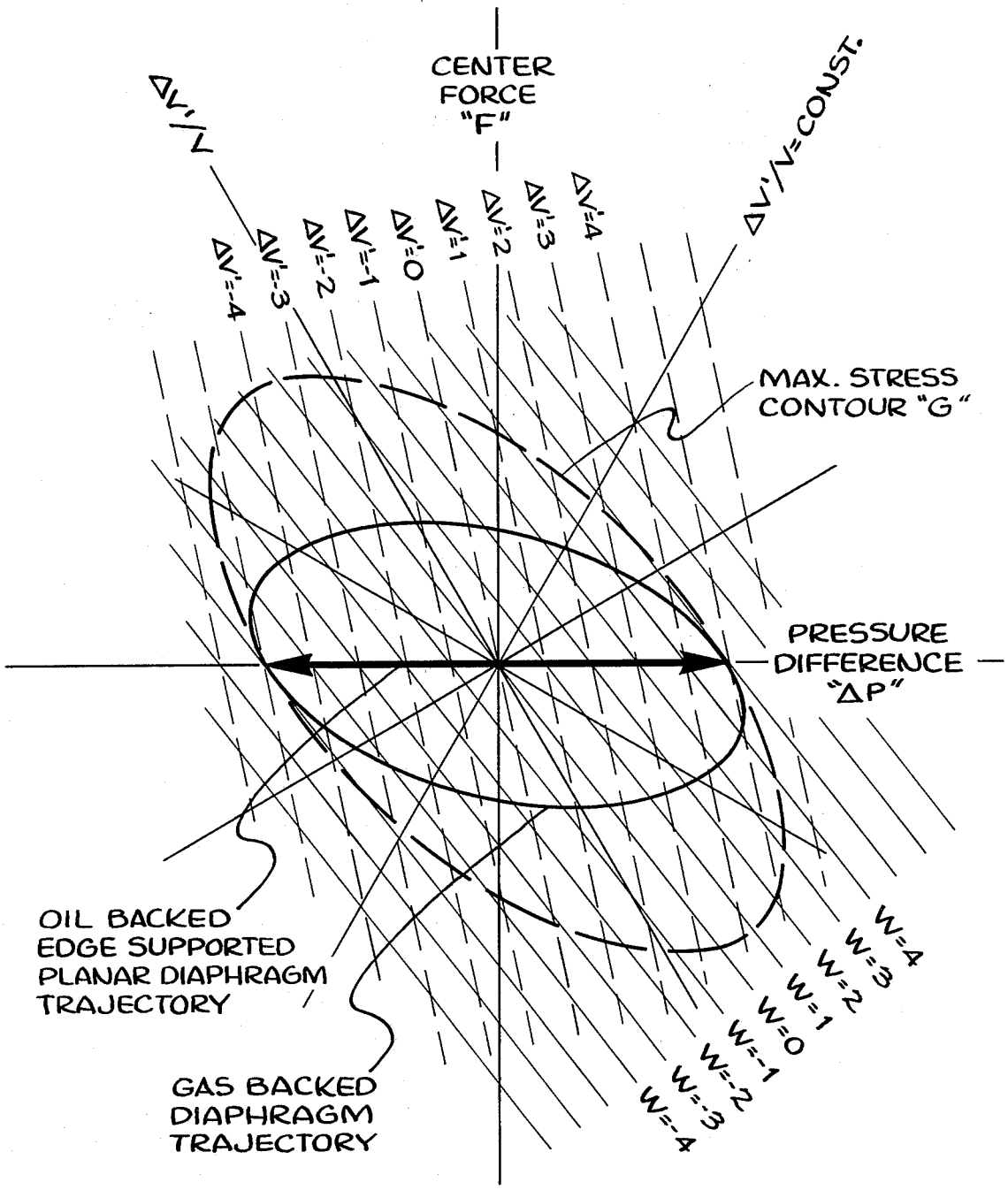
FIG. 2 is a graph showing the relationship among various parameters affecting diaphragm operation.

As shown in FIG. 2, the maximum stress to which the diaphragm 38 may be safely subjected is shown in the curve G. The force exerted on, and pressure drop across, the diaphragm must be limited to that which will produce a stress level not exceeding the level represented by the curve G. Since the diaphragm 38 is mechanically decoupled from the displacer, the force component, which exists in the diaphragms of engines disclosed in the aforementioned applications, does not exist in this diaphragm. Therefore, the only application of force on this diaphragm is the distributed fluid pressure forces acting uniformly over the face of the diaphragm. The pressure is transmitted through the diaphragm 38 and the liquid in the cavity 50 to the bottom face of the transverse wall 48. In this way, the thermodynamic system can be tapped to supply the energy needed to maintain the displacer oscillation by virtue of the differential effective area of the displacer, which is the difference between the cross-sectional area of the displacer at the hot end, and the effective area of the diaphragm 38, and the spring effect of the diaphragm.

The power input to the displacer is a function of the ratio ($\Delta V/V$), where $\Delta V$ is the difference between the displacer's volumetric displacement in the expansion and compression spaces 12 and 14, respectively, and V is the volumetric displacement of the displacer in the expansion space. A major advantage of the invention is the control it affords over the ratio ($\Delta V/V$). Without this control, the diaphragm deflects to the extent dictated by the working gas pressure wave in the engine working space, and the ($\Delta V/V$) values are determined by this deflection. By eliminating the hard mechanical connection between the displacer and the diaphragm, and controlling the volume of the cavity 50, it is possible to control the ($\Delta V/V$) ratio and produce the desired displacer stroke.

In FIG. 2, the two families of parallel lines $\Delta V'$ and W represent volumetric displacement of the diaphragm 38 as it flexes, and linear displacement of the center of the diaphragm as it flexes, respectively. Since the trajectory of the diaphragm lies on the $\Delta P$ axis in FIG. 2 there is a unique $\Delta V'$ for each W and in fact $\Delta V'$ is a linear function of W. The effective $\Delta V/V$ of a rod mounted or a posted diaphragm displacer machine (such as the aforementioned applications) is related to the ($\Delta V'/V$) of this diaphragm machine in this case by $(\Delta V'/V)=1.0-(\Delta V/V)$.

The invention thus enables a displacer, suspended indirectly by a diaphragm in a free piston Stirling engine, to operate reliably, and supplies the optimum level of power to the displacer to maintain its reciprocating motion. The diaphragm life is extended by substantially reducing pressure induced stress and concentrated mechanical force so that the primary stress to which the diaphragm is subjected is displacement induced stress, and the displacement is achieved by application of distributed fluid pressure forces only. The displacement pattern is constrained to a particular form that maintains a wide margin of safety from the maximum stress level. The displacer diaphragm is unaffected by changes in engine charge pressure or frequency, and the displacer phase and stroke can be regulated in conventional ways.

Obviously, numerous modifications and variations of the preferred embodiments will occur to those skilled in the art in view of this disclosure. Therefore, it is expressly to be understood that these modifications and variations and the equivalence thereof may be practiced while remaining within the spirit and scope of the invention as defined in the following claims.

What is claimed is:

1. In a free piston Stirling engine having a vessel defining therein a working space adapted to contain a working gas under pressure and a displacer mounted in said working space for oscillation therein to displace working gas through a heater, a regenerator and a cooler to create a cyclic pressure wave in said working gas, the improvement comprising an improved displacer mounting system including:

a rigid wall extending transversely across one end of said displacer and defining one wall of a cavity adapted to be filled with an incompressible liquid;

a diaphragm having its outer peripheral edge sealed to said vessel and extending transversely across said displacer generally parallel to said wall and defining another wall of said cavity;

means for sealing said displacer to said diaphragm while permitting axial movement of said displacer;

support means extending laterally across said cavity therewithin for axially supporting a piston;

means defining a cylinder in said rigid wall;

said piston supported axially on said support means and disposed in said cylinder, said piston having one face extending across said cylinder and forming a portion of said one cavity wall;

whereby the pressure wave in said engine is exerted against said diaphragm which transmits said pressure through said liquid to said rigid wall, and said cylinder moves relative to said piston when said displacer moves axially in said working space to maintain the volume in said cavity approximately equal at all positions of said displacer so that pressure stresses in said diaphragm are minimized.

2. The engine defined in claim 1, wherein said displacer sealing means includes a bellows sealed at its top edge to the bottom peripheral edge of said rigid wall, and sealed at its bottom edge to said vessel.

3. The engine defined in claim 1, wherein said displacer sealing means includes a sliding seal between said displacer and said vessel.

4. The engine defined in claim 1, further comprising means for preventing accumulated leaks between said piston and said cylinder.

5. The engine defined in claim 4, wherein said accumulated leak prevention means includes a second cavity sealed at one side by a second diaphragm and bounded on another side by the other face of said piston, whereby the mean pressure in said two cavities is equalized by leaks and thereafter the leakage rate between said cavities is equal.

6. The engine defined in claim 1, wherein said support means includes a spider extending across said displacer within said cavity between said diaphragm and said rigid wall including a plurality of legs attached at the outer ends thereof to said vessel and attached at their inner ends to a center body.

* * * * *